United States Patent [19]

Lemon

[11] Patent Number: 4,783,077

[45] Date of Patent: Nov. 8, 1988

[54] GOLF TEE

[76] Inventor: William C. Lemon, 594 Lucille Dr., Incline Village, Nev. 89450

[21] Appl. No.: 917,044

[22] Filed: Oct. 9, 1986

[51] Int. Cl.[4] ..... A63B 57/00

[52] U.S. Cl. ..... 273/211

[58] Field of Search ..... 273/33, 202, 203, 205, 273/207, 208, 209, 211-212

[56] References Cited

U.S. PATENT DOCUMENTS

| | | | |
|---|---|---|---|
| 1,699,934 | 1/1929 | Warner | 273/211 |
| 2,455,705 | 12/1948 | Seager | 273/211 |
| 3,347,551 | 10/1967 | Dreyfus | 273/33 |
| 4,192,504 | 11/1980 | Cluggage | 273/33 |

*Primary Examiner*—Richard C. Pinkham
*Assistant Examiner*—T. Brown
*Attorney, Agent, or Firm*—Chilton, Alix & Van Kirk

[57] ABSTRACT

A golf tee of a one piece integral molded form comprises a plurality of flutes which project generally radially from a central support pedestal. The flutes form support points to provide a support structure for supporting the golf ball in an elevated stable relationship on the tee. One or more of the flutes may be configured to facilitate proper orientation of the golf tee. The rigidity of the flutes located between the club head and the ball is greater than that of relatively flexible flutes located between the ball and the intended flight path of the ball.

1 Claim, 2 Drawing Sheets

GOLF TEE

BACKGROUND OF THE INVENTION

The present invention relates generally to golf tees. More particularly, the present invention relates to golf tees which are adapted for minimal contact between the golf tee and the golf ball.

Golf tees of numerous different configurations, shapes and functions have been proposed. The most widely employed golf tee is the nearly universally recognized solid wooden tee having a cup shaped top which is contoured to receive the golf ball and an opposing tapered tip for insertably mounting the tee in the turf. The wooden tee tends to be relatively easily broken. In addition, the solid engaging surface of the conventional tee tends to at least slightly interfere with the flight of the ball from the tee on certain types of club impact.

A number of prior art golf tees have been advanced for reducing the engagement contact between the golf ball and the golf tee. U. S. Pat. No. 1,573,911 discloses a golf tee having an elastic ring of rubber or like material which has an upstanding row of yielding lugs that extend above the plane of the ball supporting surface. The lugs do not support the ball but function as retaining means. The lugs yield easily when the ball is struck and do not interfere materially with the freedom of movement of the ball upon impact of the club.

U. S. Pat. No. 3,414,268 discloses a golf tee with a seat which is formed by a coacting central disc and a plurality of separate pedals which radiate outwardly from the disc to form a conically-shaped annular seat for the golf ball. U. S. Pat. No. 1,717,962 discloses a golf tee from which extends a plurality of bristles which are configured to provide a concave seat for supporting the ball. The bristles readily flex upon the ball being struck by the club. U. S. Pat. No. DES. 181,633 also appears to disclose a golf tee which employes longitudinally projecting radial bristle-like structures for supporting a golf ball.

British Pat. No. 435,945 discloses a portable golf tee comprising a flexible multi-pedal calyx which is fitted to a relatively rigid peg. The ball supporting calyx has a resilient structure and comprises a plurality of pedals which terminate in tips for supporting the golf ball. British Pat. No. 236,132 discloses an improved golf tee which employes tusks of bristles for supporting a golf ball. British Pat. No. 236,132 also discloses a golf tee employing a rubber like cap which is affixed with resilient prongs which support the golf ball.

SUMMARY OF THE INVENTION

The present invention is a new and improved golf tee of efficient construction which provides an elevated support for a golf ball wherein an extremely small degree of contact occurs between the golf ball and the golf tee. Consequently, the golf tee does not significantly interfere with the flight of the ball. The golf tee may be formed from molded material in an inexpensive manner.

Briefly stated, the invention in a preferred form is a golf tee which comprises an elongated pedestal having a tapered first end and an opposing second end terminating at a central support vertex. A plurality of equiangularly spaced flutes project radially from the pedestal. Each of the flutes extends longitudinally to terminate at a point like vertex which is located in longitudinally spaced relationship beyond the pedestal vertex. Each flute vertex is equidistantly spaced from the central pedestal vertex. At least one of the flutes extends along a substantial longitudinally extending portion of the pedestal with the flute tapering radially outwardly between the first and second pedestal ends. At least one of the flutes extends along only a fractional longitudinally extending portion of the pedestal proximate the second end thereof. The number of flutes is preferrably three or four. The vertices of the pedestal and the flute are spaced so that a golf ball may be supported on point contact relationship depending on the number of flutes.

The second end of the pedestal may be defined by a convex surface. In one form of the invention, two of the flutes extend along a substantial longitudinal extending portion of the pedestal. In another form of the invention, two of the flutes extend along only a fractional longitudinally extended portion of the pedestal. The flutes may comprise a substantially identical triangular shape portion which terminates to form the point-like vertex. One or more of the flutes which are adapted for positioning in close proximity to the impact area between the club head and the ball have a more rigid structure than the other flutes which are adapted to be positioned toward the forward flight path portions of the tee. Structures are formed to facilitate correct angular orientation of the tee.

An object of the invention is to provide a new and improved golf tee of efficient and inexpensive construction.

Another object of the invention is to provide a new and improved golf tee which supports a golf ball in an elevated stable relationship while presenting a minimal degree of impeding contact between a struck golf ball and the golf tee.

A further object of the invention is to provide a new and improved golf tee which may be relatively easily oriented in relation to the intended flight path of the golf ball and which presents insubstantial interference between the tee and the golf ball upon striking the golf ball.

Other objects and advantages of the invention will become apparent from the drawings and the specification.

DETAILED DESCRIPTION OF THE INVENTION

With reference to the drawings wherein like numerals represent like parts throughout the figures, a golf tee in accordance with the present invention is generally designated by the numeral 10. Golf tee 10 is a one piece molded member which is preferably formed of a slightly flexible material such as plastic. The golf tee is adapted for insertion for anchoring into the ground or turf to support a golf ball 12 in a stable elevated position. The golf tee is constructed to present an insubstantial contact area between the golf ball and the golf tee, to present a minimal degree of interference between the golf club striking a ball mounted on the tee, and to present negligible interference or contact between a struck ball and the tee which might adversely alter the path of the struck golf ball.

Figure 1:
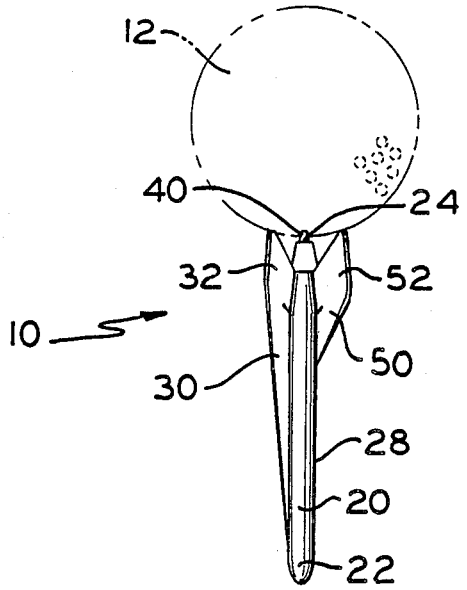
FIG. 1 is a perspective view of a golf tee in accordance with the present invention with a golf ball being illustrated in phantom.
Figure 7:
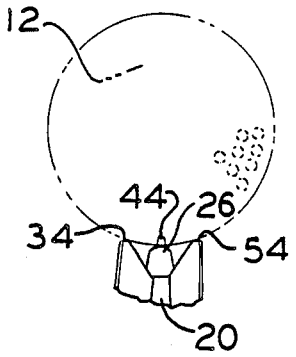
FIG. 7 is an enlarged fragmentary view of an alternate configuration for the golf tee of FIG. 1.

Golf tee 10 comprises a central support pedestal 20 which functions as the principal support structure for the tee. The lower end 22 of the support pedestal is tapered to form a point-like terminus to facilitate insertion of the tee into the ground in a conventional manner for anchoring the tee in a generally upright vertical orientation as illustrated in the drawings. The upper en of the support pedestal terminates in a end surface 24. In one embodiment, end surface 24 may be flat as illustrated in FIG. 1 or have a rounded convex shape with a central vertex portion 26 as illustrated in FIG. 7. The central vertex portion 26 functions as a central support point for the ball. In the configuration of FIG. 7 the end surface 24 functions as a ball support point and as a thrust pad for transferring the downward insertion force manually exerted through the ball to force the tee into the ground for mounting purposes.

Three fin-like structures or flutes 30, 40 and 50 extend radially from the support pedestal 20. The flutes 30, 40 and 50 are equiangularly spaced with respect to the central axis of the support pedestal. Flutes 30 and 40 are substantially identical in size and shape. Flutes 30 and 40 extend in gradually tapered relationship from the lower end 22 toward the upper end of the support pedestal to terminate in substantially triangular-shape wing-like upper projections 32 and 42. The triangular shape approximates a 30–60 degree right triangle with the hypotenuse extending radially and upwardly at approximately a 30 degree angle with the support pedestal. The flutes 30 and 40 extend from the support pedestal along a pair of angularly spaced longitudinal portions of the support pedestal. The flutes 30 and 40 have a generally streamlined configuration which transversely tapers at the upper projections to a relatively thin structure to provide a resilient semi-flexible structure at the upper extremities. The upper projections 32 and 42 terminate in upper vertices 34 and 44, respectively. Vertices 34 and 44 function as ball support points as will be further described below.

Figure 2:
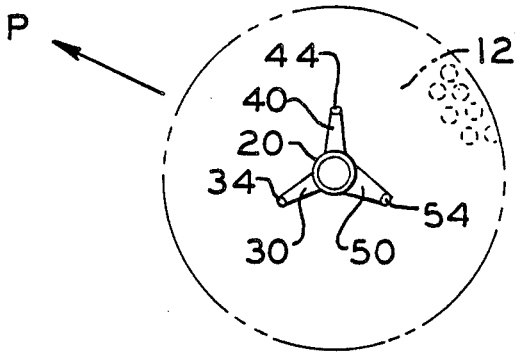
FIG. 2 is an enlarged top plan view of the golf tee of FIG. 1 with the golf ball being illustrated in phantom.
Figure 3:
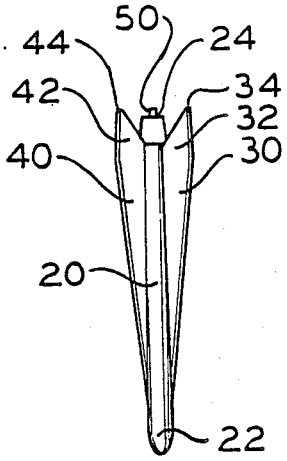
FIG. 3 is a side elevational view of the golf tee of FIG. 1 viewed generally from the left thereof.

Flute 50 differs from the foregoing described flutes 30 and 40 in that the flute extends from the support pedestal along only a fractional longitudinal portion of the support pedestal adjacent the upper end of the pedestal. Flute 50 is equidistantly spaced from flutes 30 and 40 and has a generally identical shaped construction at the upper portion thereof except that flute 50 is thicker and more rigid than flutes 30 and 40 (as best illustrated in FIG. 2). Flute 50 includes an upper substantially triangular wing-like upper projection 52 which terminates in an upper vertex 54. Vertex 54 likewise functions as a support for the golf ball. Vertices 34, 44 and 54 are preferably defined by a sharp point-like structure. The vertices dimensions may be exaggerated in the drawings for illustration purposes.

It will be appreciated that flute vertices 34, 44 and 54 are equidistantly spaced from end surface 24 and are longitudinally positioned at a location which is slightly elevated with respect to the end surface 26 of the support pedestal. In one preferred embodiment, the distance between the flute vertices is approximately 1 cm. End surface 24 and vertices 34, 44 and 54 are spaced so that a golf ball 12 may be supported in a stable elevated position on the vertices in a three point contact relationship as illustrated in FIG. 1. In the FIG. 7 configuration of the golf tee, the golf ball also lightly contacts the central vertex portion 26 to essentially provide a four point contact relationship between the ball and the tee. It should be appreciated that the dimensions of the support structures provided at the vertices 34, 44 and 54 are quite insubstantial and may be regarded as essentially point-like supporting structures.

With reference to FIG. 2, flute 50 functions to provide a ready means for orienting the golf tee in a correct angularly aligned relationship with the intended path P of the golf ball 12. The radial axis of flute 50 essentially aligns with the path P of the golf ball to define the correct angular orientation of the tee 10. The golf ball flight path from the tee is indicated by the arrow in FIG. 2. Because of the limited longitudinal extent of flute 50, the support pedestal portion below flute 50 functions as a locator surface 28. The golfer may easily grasp the golf tee so that the forefinger engages against the smooth support pedestal contour at the locator surface 28. The opposite side of the pedestal is traversed by projecting flutes 30 and 40. The thumb may simultaneously be downwardly forced against the ball and transferred via the flutes to the support pedestal 20 to thereby facilitate the forcible insertion of the tee into the ground for mounting purposes. The sensual feel of the forefingers against the tee support pedestal contour at the locator surface 28 provides a ready means for properly orienting the golf tee. The unique shape of flute 50 (in relation to flutes 30 and 40) also functions as a visual indicator to facilitate proper orienting of the golf tee.

The nature of the contact relationship between the golf tee and the golf ball may in part be a function of the degree of rigidity or flexibility of the flutes. For example, in one embodiment such as illustrated in FIG. 7, when the ball is forced against the pedestal end to inert the tee in the ground for mounting purposes, the flutes may slightly transversely deflect to allow the ball to engage the vertex portion 26 until the tee is inserted at the proper height relative to the turf. Upon release of the hand and/or thumb from the ball, the flutes may resiliently deflect so as to assume the original projecting configuration wherein the ball is essentially supported at each of the vertices 34, 44 and 54 and the ball is out of contact with the pedestal surface 24 as best illustrated in FIG. 1. However, the flutes and the support pedestal may also be constructed so that in a normal mounting configuration the ball contacts each of the flute vertices 34, 44 and 54 as well as the support pedestal to form essentially a four point supporting configuration as best illustrated in FIG. 7. In a preferred form, the flutes are sufficiently rigid that the ball does not contact the end surface even on forcibly downwardly inserting the ball-/tee assembly into the turf.

Figure 4:
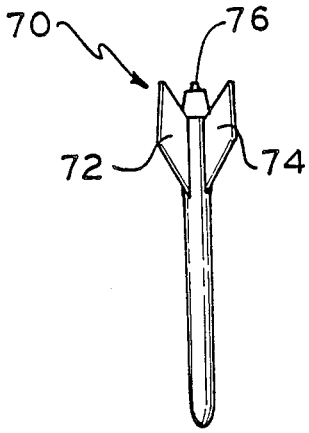
FIG. 4 is a side elevational view illustrating a second embodiment of a golf tee in accordance with the present invention.

With reference to FIG. 4, an alternate embodiment of a golf tee in accordance with the present invention is generally designated by the numeral 70. Golf tee 70 is identical in form and function to golf tee 10 except that flutes 72 and 74 are substantially identical to flute 50 and flute 76 (only partially illustrated) is substantially identical to flute 30 and/or flute 40. For the embodiment of golf tee 70, flute 76 radially aligns with the ball flight path and functions as a visual indicator to provide the correct alignment of the golf tee with the intended ball flight path.

When properly oriented, the flutes 50 and 76 are located indirectly or directly between the club head and the golf ball just prior to the club striking the ball. It should be appreciated that for both golf tees 10 and 70, the respective rearwardly positioned flutes 50 and 76 have a thicker more rigid structure than the other flutes to prevent the breakage upon impact between the club head and the ball. The forwardly positioned flutes 30 and 40 of golf tee 10 and 72 and 74 of golf tee 70 have thinner semi-flexible resilient structures which are yieldable upon club/ball impact so as to present no or at most an insubstantial interference with the struck ball. Consequently, the minimal contact relationship between the tee and the ball results in a golf tee which does not impedingly alter the flight path of the ball. Additionally, because of the minimal ball flight interference of the golf tee, the golf tee is much more resistant to breakage resulting from the impact of the club against the ball.

Figure 5:
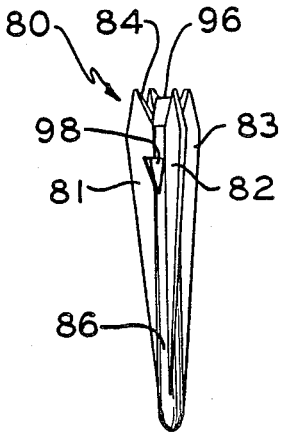
FIG. 5 is a perspective view of a third embodiment of a golf tee in accordance with the present invention.
Figure 6:
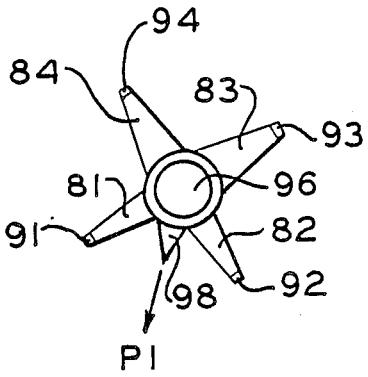
FIG. 6 is an enlarged top plan view of the golf tee embodiment of FIG. 5.

With reference to FIGS. 5 and 6, another embodiment of a golf tee in accordance with the present invention is generally designated by the numeral 80. Golf tee 80 employes four flutes 81, 82, 83 and 84 which are equiangularly spaced with respect to the central support pedestal 86. Flutes 81, 82, 83 and 84 each have a surface shape which is generally identical to that of flute 30. Two of the flutes 81 and 83 are thinner than flutes 83 and 84 which preferably have a substantially more rigid structure. When the tee 80 is properly oriented flutes 83 and 84 project radially generally rearwardly toward the club head (prior to impact) and flutes 81 and 82 project radially generally forwardly toward the intended path P′ of the golf ball. It should be appreciated that the more rigid members 83 and 84 are adapted to withstand the impact of the club head while the forwardly positioned flutes 81 and 82 are more flexible so as to present minimal ball interference with the intended path of the ball upon club impact with the ball. The golf ball is preferably supported on tee 80 in a substantially four point contact relationship with the ball being supported at corresponding vertices 91 through 94 of the respective flutes 81 through 84. Alternately, the ball may be mounted in a substantially five point contact relationship wherein the ball also lightly rests on the central portion of the upper end surface 96 of the support pedestal 86.

A pointer 98 having a tapered triangular form may integrally extend from the support pedestal for visually indicating the correct orientation of the tee with respect to the intended flight path P′ of the golf ball. It should be appreciated that pointer 98 may assume a variety of forms and configurations which function to visually indicate the proper angular orientation of the golf tee. The proper orientation of the golf tee may also be ascertained by visually inspecting the thicknesses of the flutes, and angularly orienting the tee 80 so that the thicker more rigid flutes are positioned rearwardly from the ball toward the club head rior to impact. In another embodiment (not illustrated) a pair of the forward flutes may have a structure such as flutes 72 and 74 of the FIG. 4 embodiment.

While preferred embodiments of the foregoing invention have been set forth for purposes of illustration, the foregoing description should not be deemed a limitation to the invention herein. Accordingly, various modifications, adaptations and alternatives may occur to one skilled in the art without departing from the spirit and the scope of the present invention.

What is claimed is:

1. A one-piece plastic golf tee comprising a straight elongated central pedestal with a longitudinal axis and having an elongated generally cylindrical central portion, a pointed end portion at its lower end to facilitate insertion of the golf tee into the ground and an upper, generally conical end portion having an upper transverse end surface; three flutes generally equiangularly spaced about and projecting radially outwardly from said central pedestal, the three flutes having three upper triangular end portions respectively, extending upwardly and radially outwardly from the central pedestal and having point-like vertices respectively, at the upper ends thereof, the three vertices being located in a common plane transverse to the longitudinal axis of the pedestal and above said upper end surface of the pedestal and having the same radial spacing from said longitudinal axis, the three vertices being spaced above the upper end surface of the pedestal to support a golf ball thereon directly above and in alignment with the pedestal, two of said flutes being substantially identical, relatively long, forward flutes extending from upper ends thereof downwardly and gradually tapering inwardly toward the pedestal to lower ends thereof above the lower end of the pedestal, the third of said flutes being a relatively short, rearward flute spaced evenly between the first and second forward flutes and extending from the upper end thereof downwardly and sharply tapering inwardly toward the pedestal to a lower end thereof substantially above the lower ends of the first and second forward flutes for use in combination with the forward flutes as a guide for positioning the golf tee with the rearward flute aligned with but extending in the opposite radial direction from the intended flight of a golf ball supported on the three flute vertices.

* * * * *